US007033042B2

(12) United States Patent
Lim

(10) Patent No.: US 7,033,042 B2
(45) Date of Patent: Apr. 25, 2006

(54) EMERGENCY FLASHLIGHT

(75) Inventor: In-Teak Lim, Seoul (KR)

(73) Assignee: Safeline Co., LTD, Seoul (KR)

( * ) Notice: Subject to any disclaimer, the term of this patent is extended or adjusted under 35 U.S.C. 154(b) by 0 days.

(21) Appl. No.: 10/728,414

(22) Filed: Dec. 5, 2003

(65) Prior Publication Data

US 2004/0252497 A1 Dec. 16, 2004

(30) Foreign Application Priority Data

Jun. 11, 2003 (KR) ..... 10-2003-0037638
Aug. 29, 2003 (KR) ..... 20-2003-0027769

(51) Int. Cl.
*F21L 4/04* (2006.01)

(52) U.S. Cl. ..... 362/202; 362/191; 362/658; 362/375; 362/374; 362/432; 362/183; 362/208

(58) Field of Classification Search ..... 362/202, 362/147, 190, 191, 226, 374, 375, 432, 200, 362/183, 201, 208, 253, 640, 658; 340/686.1, 340/687, 686.2, 686.6
See application file for complete search history.

(56) References Cited

U.S. PATENT DOCUMENTS 1,591,980 A * 7/1926 Jones ..... 362/202
5,413,223 A 5/1995 Kang
5,629,679 A * 5/1997 Cranford et al. ..... 340/574
5,952,916 A * 9/1999 Yamabe ..... 340/468
6,179,431 B1 * 1/2001 Chien ..... 362/84

* cited by examiner

*Primary Examiner*—Sandra O'Shea
*Assistant Examiner*—Sharon Payne
(74) *Attorney, Agent, or Firm*—Thorpe North & Western

(57) ABSTRACT

An emergency flashlight has a flashlight body, and a holder supporting the body. The body includes a receiving section that stores small batteries, an electric lighting section, and a lower covering section. The holder includes a holder body section fixed to a structure such as a wall, a support section extending from the holder body section, and a protecting section horizontally extending from the holder body section. A cap is pivotally supported by opposite ends of the support section through a hinge shaft. A transverse through slot is formed on the receiving section included in the flashlight body. A partition plate is placed on the support section of the holder in a location corresponding to the through slot, wherein the partition plate separates the battery circuit when the flashlight body is placed in the holder.

9 Claims, 8 Drawing Sheets

EMERGENCY FLASHLIGHT

This application claims priority to Korean Patent Application No. 10-2003-0037638 filed Jun. 11, 2003; and Korean utility Model Application No. 20-2003-0027769 filed Aug. 29, 2003.

BACKGROUND OF THE INVENTION

1. Technical Field of the Invention

This invention relates to an emergency flashlight, and more particularly to an emergency-flashlight having a flashlight body supported by a holder and a cap, designed to prevent the flashlight body from theft and loss.

2. Description of Related Art and Background of the Invention

Emergency flashlights are often kept in chests of drawers located within rooms, such as living rooms, without being held in a holder. Emergency flashlights are also constructed to be manually turned on during an emergency situation and to be manually turned off when not in use.

Emergency flashlights should be kept in readily visible locations for prompt use in the event of an emergency such as a power failure or disaster. However, emergency flashlights placed in an invisible location, such as the chest of drawers, are not readily useful in such emergencies. Even though a user may know the location of an emergency flashlight, it may be difficult for the user to readily find the flashlight in the event of an emergency. In addition, even if the user finds the flashlight, it may be impossible for the user to turn on the flashlights.

BRIEF SUMMARY OF THE INVENTION

An object of this invention is to provide an emergency flashlight having a flashlight body which is attached to a holder affixed to a wall. The flashlight can turn on when it is out of the holder, enabling a user to readily find the flashlight. A cap designed to be openable and closable relative to the holder, protects the flashlight body from theft and loss.

A further object of this invention is to provide an emergency flashlight which has a flashlight body with a luminous layer coated or adhered on a center portion thereof. The luminous layer enables the user to easily find the flashlight in the event of an emergency situation such as a power failure or disaster.

In order to achieve the above object, the emergency flashlight according to the present invention has a flashlight body, and a holder supporting it. The flashlight body includes a receiving section storing small batteries therein, an electric lighting section equipped on an upper side of the receiving section, and a lower covering section equipped on a lower side of the receiving section. The holder includes a holder body section fixed to a structure such as a wall, and a support section extending from the holder body section. The holder supports the flashlight body with a protecting section that extends horizontally from the holder body section and covers the electric lighting section of the flashlight body. A cap is pivotally supported by opposite ends of the support section through a hinge shaft. A transverse through slot is formed in the receiving section in the flashlight body. A partition plate is placed on the support section of the holder in a location corresponding to the through slot, and extends into the receiving section via the through slot of the receiving section when the flashlight body is in the holder. The partition plate is configured to interrupt electrical contact between the batteries by being interposed between the batteries.

DETAILED DESCRIPTION OF EMBODIMENTS

Figure 1:
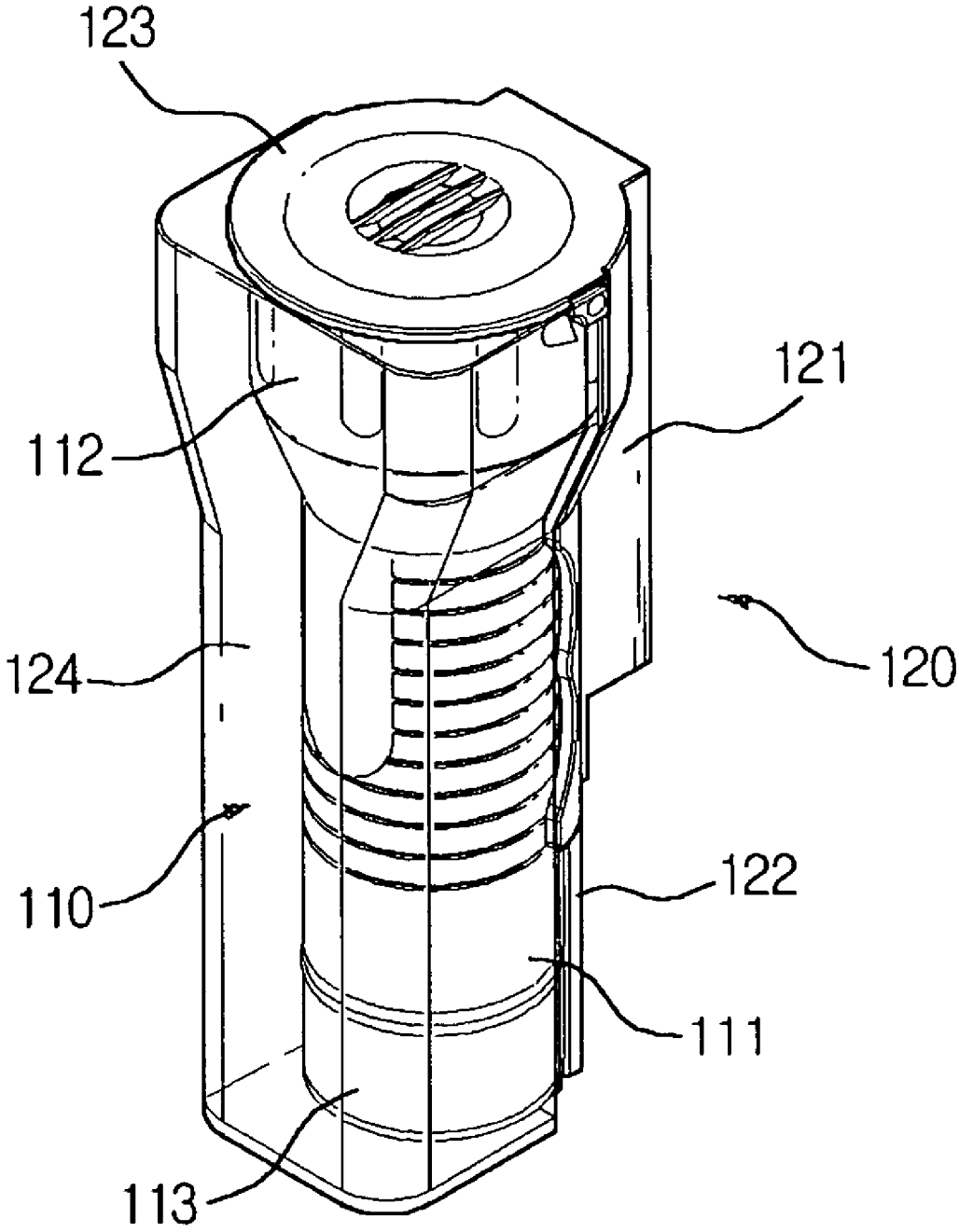
FIG. 1 is an assembled perspective view of an emergency flashlight according to a first embodiment of the present invention.

An embodiment of an emergency flashlight according to the present invention will be hereinafter described in detail with reference to the attached drawings.

Referring to FIGS. 1 to 5, there is shown an emergency flashlight according to a first embodiment of the present invention.

An emergency flashlight according to the first embodiment comprises a flashlight body 110, and a holder 120 holding it. The holder is provided with a cap 124 which is designed to be openable and closable relative to the holder.

The flashlight body 110 includes a receiving section 111 for storing a plurality of small batteries 9. An electric lighting section 112 can be equipped at an upper side of the receiving section 111. A lower covering section 113 can be equipped at a lower side of the receiving section 111.

The holder 120 includes a holder body section 121 fixed to a structure such as a wall. A support section 122 can extend from the holder body section 121 and can support the flashlight body 110. A protecting section 123 can extend horizontally from the holder body section 121 and can cover the electric lighting section 112 of the flashlight body 110. The cap 124 can be pivotally supported by opposite ends of the support section 122 through a hinge shaft 124*a*.

In the first embodiment, four small batteries are received in the receiving section 111. The electric lighting section 112 is screwed-fitted with one end of the receiving section 111, and the lower covering section 113 is screwed-fitted with another end of the receiving section 111. The small batteries 9 received in the receiving section 111 may be taken out of the receiving section when the lower covering section 113 is disengaged from the receiving section.

A hook member 114 can be formed in a rear side of the receiving section 111 to facilitate portability of the flashlight body 110 when removed from the holder 120.

Advantageously, the hook member can be attached to various objects such as a belt, or a handle ring of hand bag, thereby making the flashlight more portable after the flashlight body 110 is taken out of the holder 120. The hook member 114 may be of elastic material.

The electric lighting section 112 is powered and turned on through the batteries 9 received in the receiving section 111.

Figure 2:
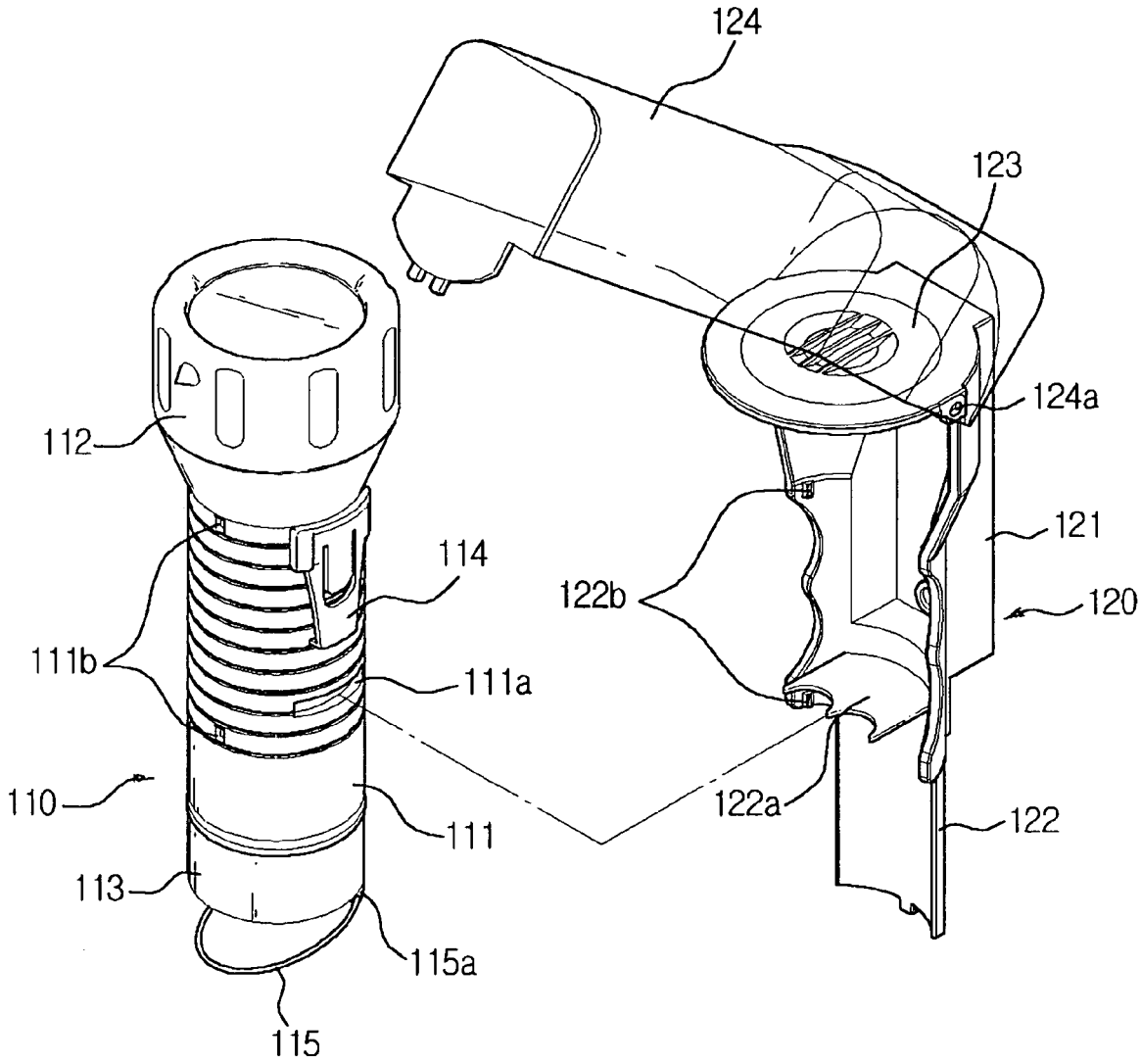
FIG. 2 is an exploded perspective view of the emergency flashlight of FIG. 1.

As shown in FIG. 2, a ring member 115 can be formed in a lower end of the lower covering section 113. The ring member can be pivotally supported by a hinge shaft 115*a* mounted to a lower end of the receiving section 111, so that the flashlight body 110 can be hung on a peg, a clothes hanger, or the like, when the flashlight body 110 is taken out of the holder 120.

Figure 3:
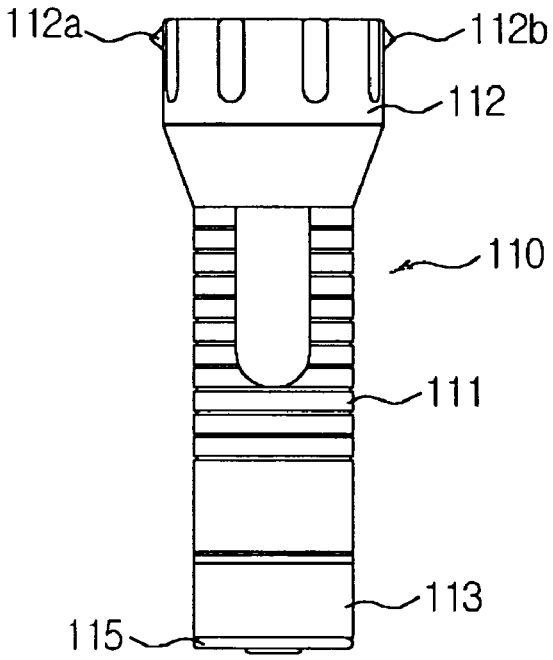
FIG. 3 is a front view of a flashlight body taken out of a holder of the emergency flashlight of FIG. 1.

As shown in FIG. 3, a glass cutting edge 112*a* is attached to a left side of the electric lighting section 112. A hammer piece 112*b* having a gimlet shape is attached to a right side of the electric lighting section 112. The hammer piece can be made of alloy steel or stainless-steel material. Advantageously, the glass cutting edge 112*a* and hammer piece 112*b* can allow the user to cut, strike and break glass and other debris during emergency situation.

The holder body section 121 may be fixed to a structure such as a wall by means of a peg, bonding tape, or other fastener as known in the art.

Figure 4:
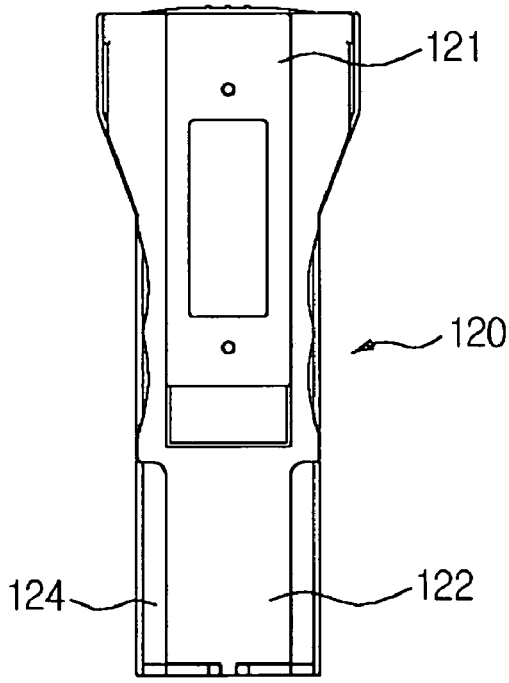
FIG. 4 is a rear view of the holder of the emergency flashlight of FIG. 1 when the flashlight body is taken out of the holder.

As shown in FIG. 4, the support section 122 extends downward by the same length as the longitudinal length of the flashlight body 110, and has a shape corresponding to the flashlight body 110. In the first embodiment, the flashlight body 110 has a cylindrical shape and the support section 122 has a similar shape so that it can cover the flashlight body 110.

The cap 124 may be opened and closed on the holder by pivoting around a hinge shaft 124*a*. The cap 124 must be open with respect to the holder before the flashlight body 110 can be separated from the support section 122 by a user.

The cap 124 can have a shape and size that generally covers and protects the flashlight body 110. A lower end of the cap can abut with a lower end of the support section 122. The cap 124 can be made of transparent acryl material or other similar materials, as known in the art, in order for the flashlight body 110 to be easily seen when in the holder.

Figure 5:
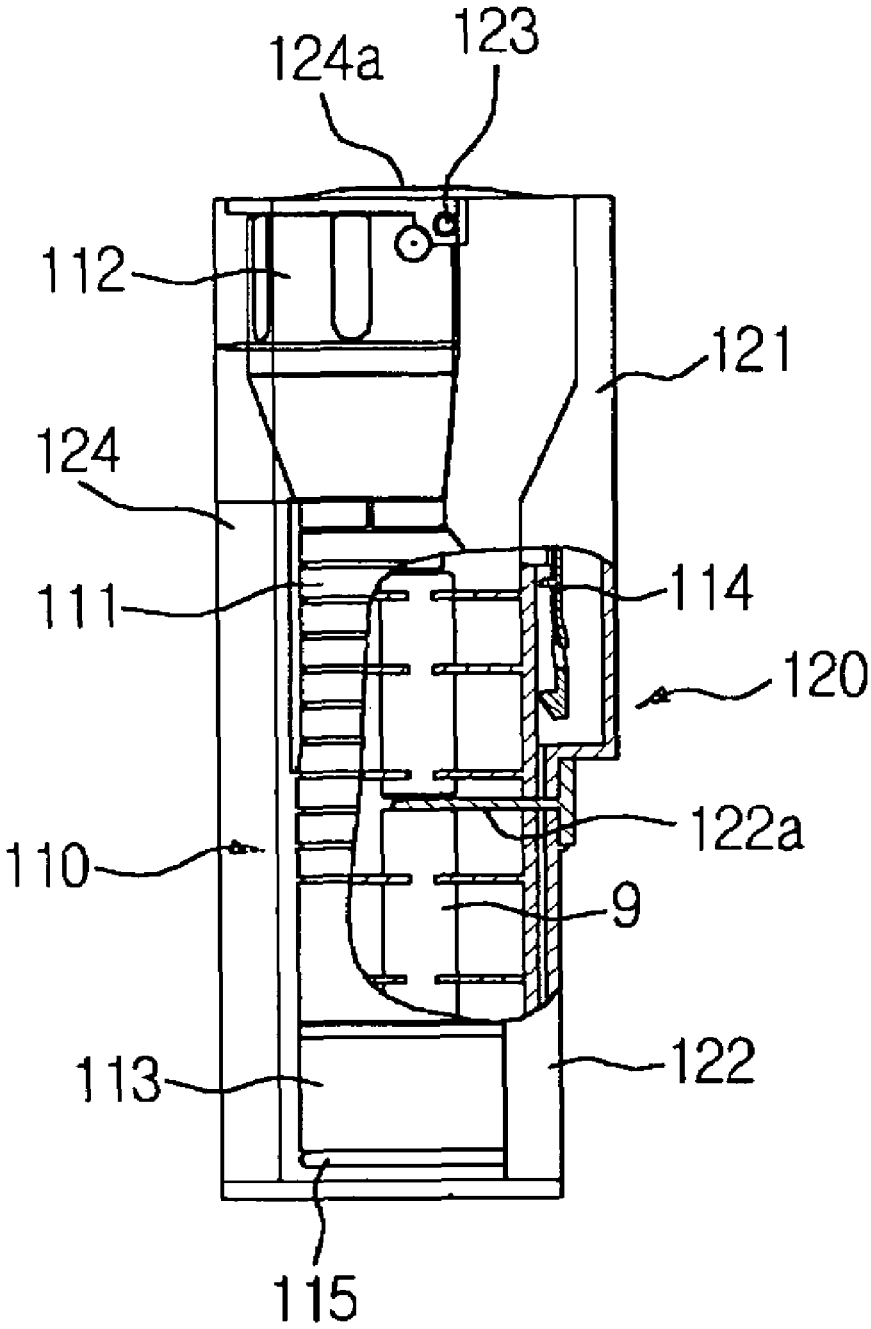
FIG. 5 is a portion cut-away elevation view of the assembled emergency flashlight of FIG. 1.

As shown in FIG. 2 and FIG. 5, a transversely lengthy through slot 111*a* is formed on an approximate center portion of the outer periphery surface of the receiving section 111 included in the flashlight body 110. A partition plate 122*a* is placed on the support section 122 of the holder 120 in a location corresponding to the through slot 111*a*. The partition plate extends toward the through slot.

As shown in FIG. 5, the partition plate 122*a* is interposed between the batteries 9 via the through slot 111*a* of the receiving section 111, thereby interrupting electrical contact between the batteries. Thus, the flashlight body 110 is turned on when it is separated from the holder 120 and the partition plate 122*a* is removed from between the batteries 9. Similarly, the flashlight body is turned off when placed in the holder 120 because the partition plate 122*a* is interposed between the batteries 9. Advantageously, no separate switch is needed to turn the flashlight body on or off. Additionally, since the batteries are not in contact with each other when the flashlight body 110 is placed in the holder 120, the batteries are prevented from discharging, thus enhancing the life of the batteries.

In the emergency flashlight of the first embodiment, the support section 122 of the holder includes a pair of projections 122*b* on each of the left and right sides. The receiving section 111 of the flashlight body includes a pair of concave portions 111*b* corresponding in shape and size to the pair of projections 122*b*. The concave portions are located on outer periphery surfaces that correspond in location to the pair of projections so that the flashlight body 110 and the holder 120 can be securely fit to each other. Therefore, the flashlight body 110 and the holder 120 may be removably coupled to each other by elastic force between the pair of projections 122*b* and the pair of concave portions 111*b*.

Thus, when the emergency flashlight according to the first embodiment is placed in the holder 120, the partition plate 122*a* is inserted into the through slot 111*a* of the flashlight body, and the projections 122*b* of the support section are inserted into the concave potions 111*b*, so that the flashlight body 110 and the holder 120 may be removably coupled to each other.

Referring to FIGS. 6 to 10, there is shown an emergency flashlight according to a second embodiment of the present invention.

The description of the emergency flashlight of the second embodiment will omit description of members similar to members of the first embodiment and the members of the second embodiment are indicated as the same reference numbers or the like numbers of the first embodiment hereinafter.

Thus, similar to the emergency flashlight described above the emergency flashlight of the second embodiment comprises a flashlight body 210, and a holder 220 holding it 210. The holder is provided with a cap 224 designed to be open and close relative to the holder.

The flashlight body 210 includes a receiving section 211 for storing a plurality of small batteries 9. An electric lighting section 212 can be equipped at an upper side of the receiving section 211. A lower covering section 213 can be equipped at a lower side of the receiving section 211.

The holder 220 includes a holder body section 221 fixed to such a structure such as a wall. A support section 222 extends from the holder body section 221 and supports the flashlight body 210. A protecting section 223 extends horizontally from the holder body section 221 and covers the electric lighting section 212 of the flashlight body 210. A cap 224 can be pivotally supported by opposite ends of the support section 222 through a hinge shaft 224*a*.

Figure 6:
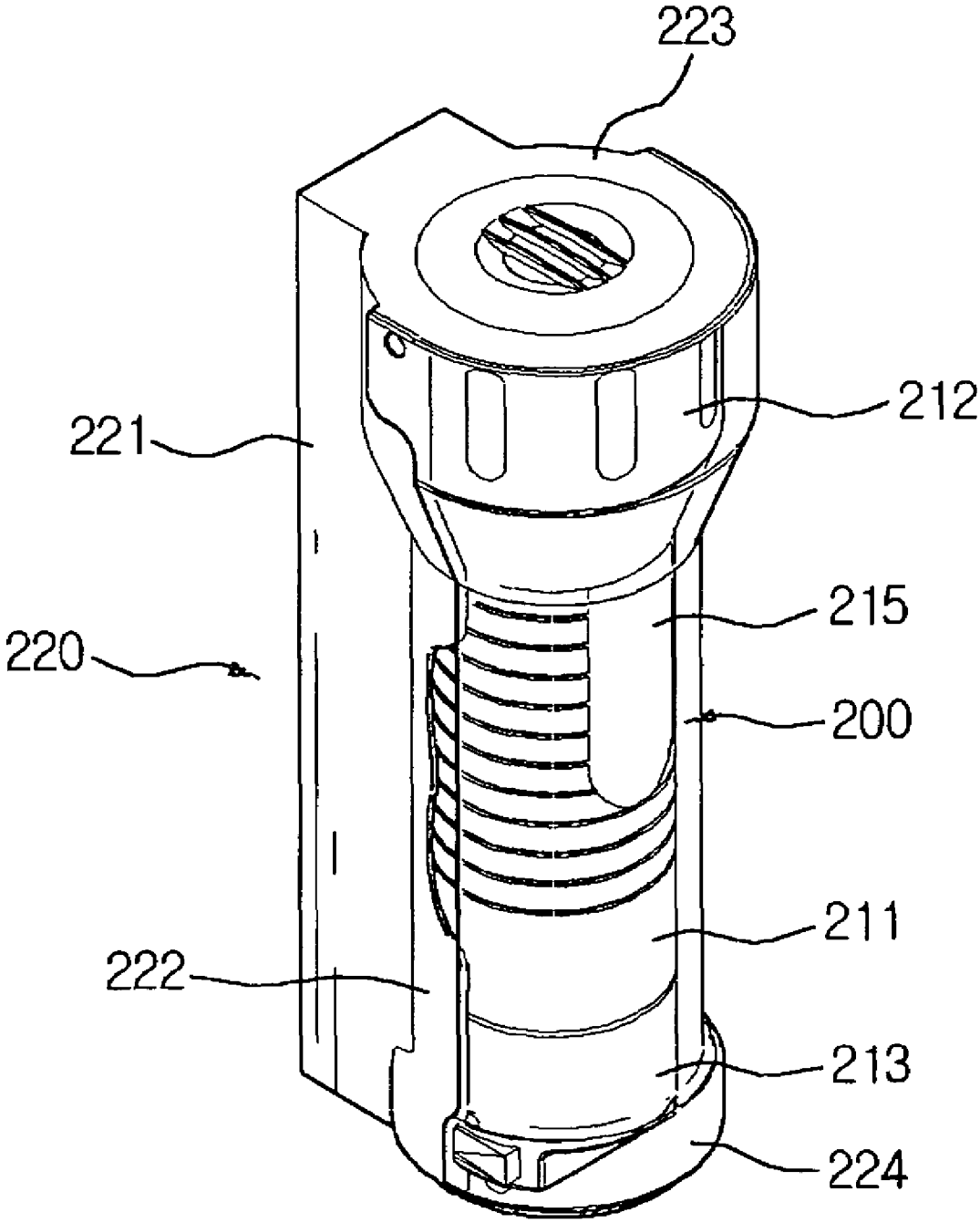
FIG. 6 is an assembled perspective view of an emergency flashlight according to a second embodiment of the present invention.
Figure 7:
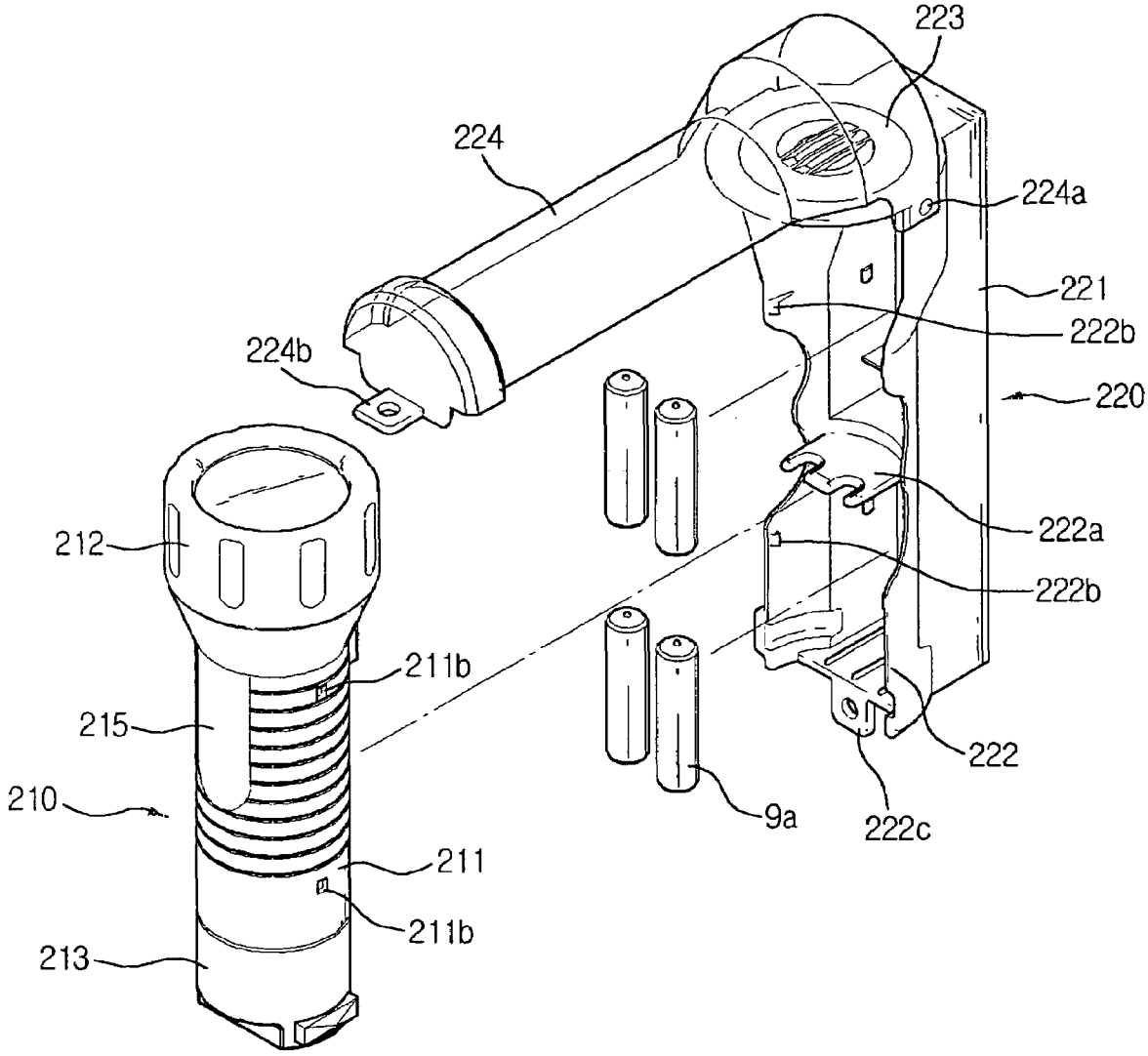
FIG. 7 is an exploded perspective view of the emergency flashlight of FIG. 6.

As shown in FIGS. 6 and 7, a luminous layer 215 is adhered on a front center portion of the receiving section 211, directed toward a front side when the flashlight body 210 is held in the holder 220. That is, the luminous layer is adhered to a center portion of the receiving section 211 that is visible from the outside. The luminous layer 215 may be attached to the receiving section by a coating or adhering process. The luminous layer can be made of a known material that can receive and store a light when exposed to light, and emit the light by itself in the dark later. The material of the luminous layer can be of a light storing material that is able to emit a light for about 20 minutes and can be visible from a 10 meter distance, but the present invention is not limited to the above.

Figure 8:
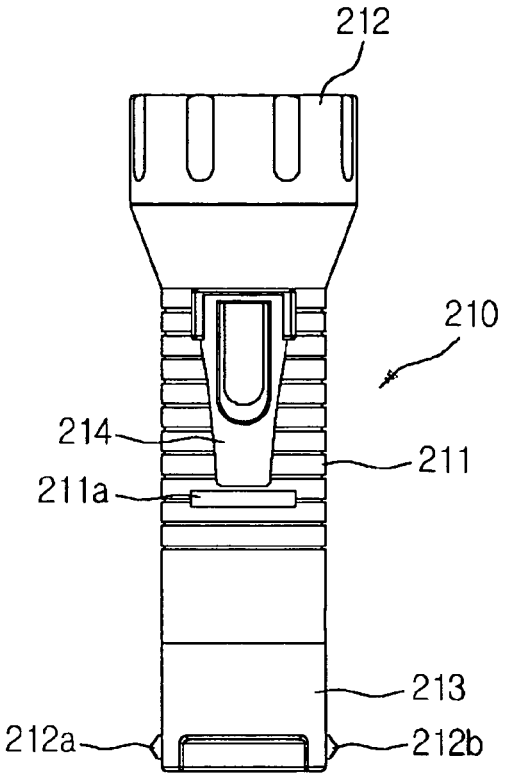
FIG. 8 is a rear view of a flashlight body taken out of a holder of the emergency flashlight of FIG. 6.
Figure 9:
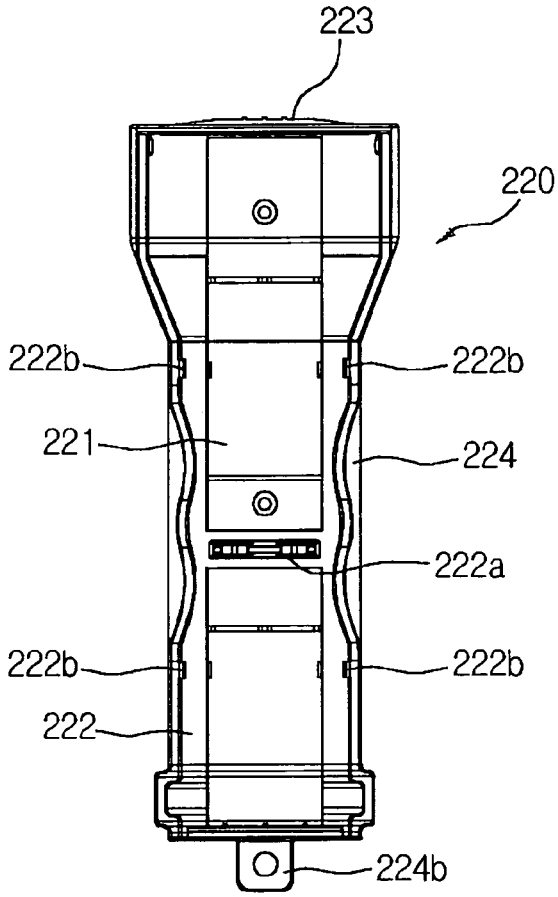
FIG. 9 is a front view of the holder of the emergency flashlight of FIG. 6 when the flashlight body is taken out of the holder.
Figure 10:
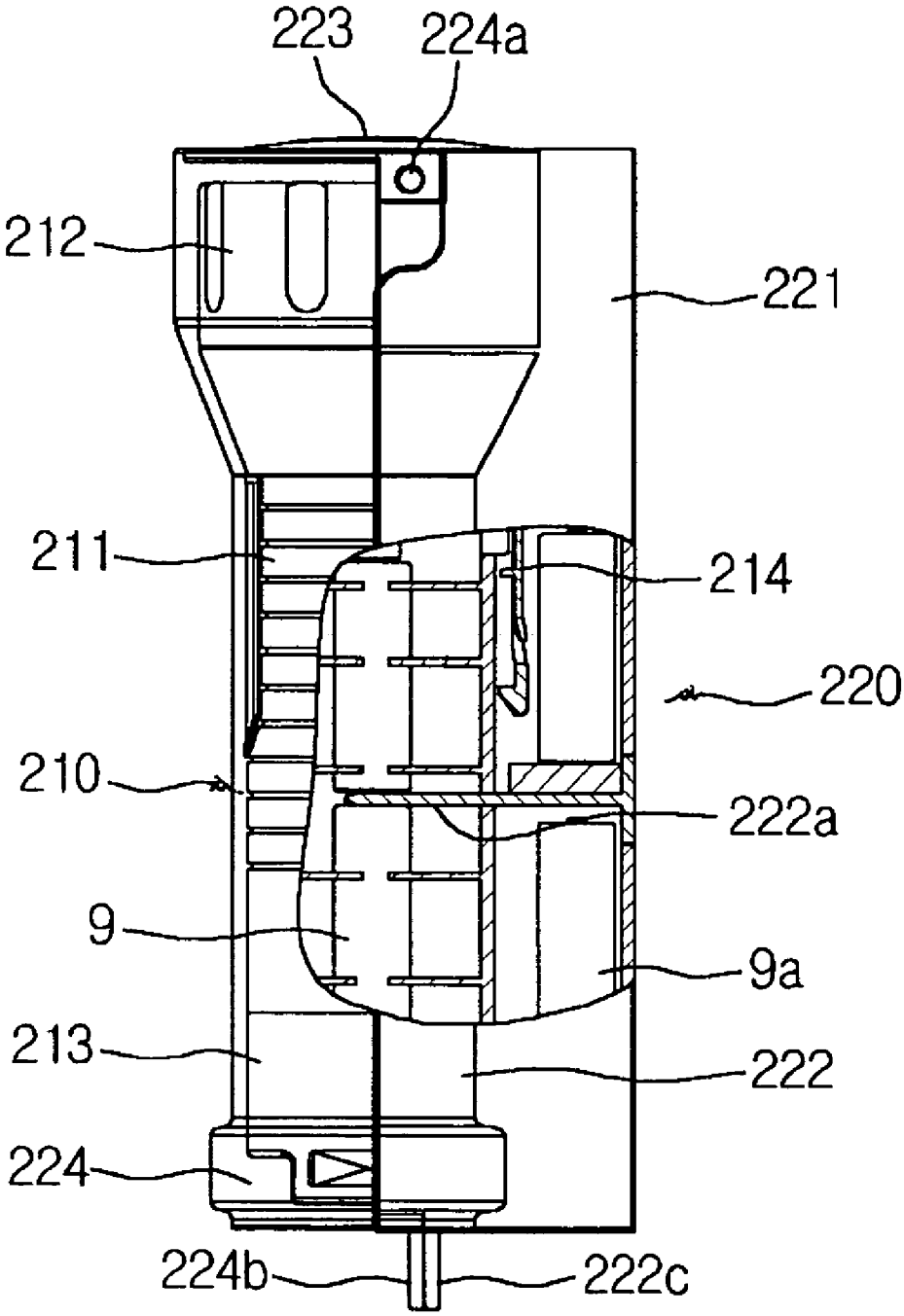
FIG. 10 is a portion cut-away elevation view of the assembled emergency flashlight of FIG. 6.

As shown in FIG. 8, the second embodiment can have a glass cutting edge 212*a* attached to a one side of a lower end of the lower covering section 213. A hammer piece 212*b*, made of alloy steel or stainless-steel material, is attached to another side of the lower end of the lower covering section 213. The glass cutting edge 212*a* and a hammer piece 212*b* are useful in cutting, striking and breaking glass or other debris during an emergency situation.

The flashlight body 210 stores batteries and the lower covering section 213 is heavier than the electric lighting section 212. Thus the weight of the batteries and lower covering section enables the hammer piece to deliver a stronger striking force to the glass when the glass is hit by the hammer piece. Advantageously, such an arrangement prevents the bulb in the electric lighting section, and other easily breakable members of the flashlight from being damaged when the hammer piece is used.

A hook member 214 can be formed in a rear side of the receiving section 211 to facilitate portability of the flashlight body 210 when removed from the holder 220.

An inner space of the holder body section 221 is fixed to a structure such as a wall by means of a peg, bonding tape or other fastening material as known in the art. The inner space can receive spare batteries 9*a* that are the same as the batteries 9 within the flashlight body 210. Thus, advantageously, when the batteries within the flashlight body are run down, the spare batteries can be changed with the run down batteries making it possible to continuously use the flashlight.

The cap 224 generally covers and protects the flashlight body 210. The lower end of the cap can be locked to a lower end of the support section 222 by a locking means such as a small size lock, soldering process, or other locking means that is not easily unlocked, as known in the art. The locking means prevents the flashlight body from theft and loss. Projections 222*b* and 224*c* can be formed in a lower end of the cap 224 and a lower end of the support section 222, respectively. The projections can have perforate holes formed therein so that the locking means can be mounted thereto. The locking means is not described in detail hereinafter because any locking means known in the art may be substituted for the lock.

The cap 224 can have a plurality of grooves formed on its surface. The grooves can weaken the cap so that the cap can be broken easily with very little force. Thus, when the cap is closed and locked to the support section 222, the cap can be broken by a little force, so that the flashlight body 210 can be easily removed from the holder. The plurality of grooves, although not shown in the Figs., can be formed on the surface of the cap, and can have the shape of a dotted line or a solid line. The plurality of grooves can be arranged in a single row or two rows through the entire surface of the cap, or only a portion of the surface of the cap. Other arrangements of the grooves, can be used to facilitate breaking of the cap to gain access to the flashlight body.

As explained above, the lower end of the cap 224 and the lower end of the support section 222 can be abutted and locked to each other. Additionally, the lower end of the cap and lower end of the support section can be made of a conductive material so that a circuit can be formed by when the cap and support section are in contact with each other. Thus, when the cap and support section are separated from each other, the circuit is disrupted and an alarm will sound. Advantageously, this alarm will alert anyone nearby that the flashlight body has been removed from the holder, thereby preventing theft or inadvertent loss.

As in the first embodiment, the second embodiment, can have a transverse through slot 211*a* formed at an approximate center portion of the receiving section 211 included in the flashlight body 210. A partition plate 222*a* can be placed on the support section 222 of the holder in a location corresponding to the through slot 211*a*. The partition plate can extend into the through slot (refer to FIG. 7 and FIG. 10) when the flashlight body 210 is placed in the holder 222.

The support section 222 of the holder can include a pair of projections 222*b* on each of left and right sides. The receiving section 211 of the flashlight body can include a pair of concave portions 211*b* having a shape and size that fits with the pair of projections 222*b* on a outer periphery surface, respectively, so that the flashlight body 210 and the holder 220 securely fit to each other. Thus, the flashlight body 210 and the holder 220 may be removably coupled to each other by elastic force between the pair of projection 222*b* and the pair of concave portions 211*b*.

Also, the flashlight body 210 can include means for turning on the flashlight when it is separated from the holder 220 and can include a speaker (not shown) for sounding an alarm by a separate circuit. The alarm can be configured to sound for a predetermined time or to be turned off by a separate switch at user's option.

The emergency flashlights according to the foregoing embodiments, enable the flashlight body to be placed in a desired area such as a visible wall by means of the holder. The user can easily find the flashlight body and the flashlight body can be turned on as soon as it is taken out of the holder without any activation of a separate switch, thus allowing the user to rapidly meet the emergency situation. Additionally, the emergency flashlight of the present invention sounds an alarm when the flashlight body is taken out of the holder, thereby preventing theft and enabling the user to easily find the flashlight body.

The invention claimed is:

1. An emergency flashlight comprising a flashlight body, and a holder supporting said body:

in which said body includes a receiving section storing small batteries therein, an electric lighting section equipped at upper side of said receiving section and a lower covering section equipped at a lower side of said receiving section;

said holder includes a holder body section fixed to a structure or a wall, a support section extending from said holder body section and supporting said flashlight body, a protecting section horizontally extending from said holder body section and covering said electric lighting section of said flashlight body, and a cap pivotally supported by opposite ends of said support section through a hinge shaft;

on said receiving section included in said flashlight body, a transversely lengthy through slot is formed, and on said support section of said holder, a partition plate is placed and extended in a location corresponding to said through slot, so that said partition plate is inserted into said receiving section via said through slot of said receiving section and interposed between said batteries, interrupting electrical contact between said batteries when said flashlight body is fitted in said holder;

wherein in a rear side of said receiving section, a hook member is formed to provide portability for a user after said flashlight body is taken out of said holder; and said cap is made of transparent acryl material in order for said flashlight body held within said holder to be found easily and has such a shape and size that said cap generally covers and protects said flashlight body.

2. The emergency flashlight as claimed in claim 1, wherein said flashlight body includes a speaker for sounding an alarm when said flashlight is separated from said holder.

3. The emergency flashlight as claimed in claim 1, wherein a glass cutting edge is attached to one side of said flashlight body, and a hammer piece is attached to another side of said flashlight body.

4. An emergency flashlight comprising a flashlight body, and a holder supporting said body:

in which said body includes a receiving section storing small batteries therein, an electric lighting section equipped at upper side of said receiving section and a lower covering section equipped at a lower side of said receiving section;

said holder includes a holder body section fixed to a structure or a wall, a support section extending from said holder body section and supporting said flashlight body, a protecting section horizontally extending from said holder body section and covering said electric lighting section of said flashlight body, and a cap pivotally supported by opposite ends of said support section through a hinge shaft;

on said receiving section included in said flashlight body, a transversely lengthy through slot is formed, and on said support section of said holder, a partition plate is placed and extended in a location corresponding to said through slot, so that said partition plate is inserted into said receiving section via said through slot of said receiving section and interposed between said batteries, interrupting electrical contact between said batteries when said flashlight body is fitted in said holder;

wherein for preventing said flashlight body from theft, projections having a perforate hole are formed in a lower end of the cap and a lower end of said support section, respectively; in order for a locking means to be mounted thereto; and in case that said cap is locked to said support section through said locking means, a plurality of grooves are formed on surface of cap in order that said cap is broken easily.

5. The emergency flashlight as claimed in claim 4, wherein said flashlight body includes a speaker for sounding an alarm when said flashlight is separated from said holder.

6. The emergency flashlight as claimed in claim 4, wherein a glass cutting edge is attached to one side of said flashlight body, and a hammer piece is attached to another side of said flashlight body.

7. An emergency flashlight comprising a flashlight body, and a holder supporting said body:

in which said body includes a receiving section storing small batteries therein, an electric lighting section equipped at upper side of said receiving section and a lower covering section equipped at a lower side of said receiving section;

said holder includes a holder body section fixed to a structure or a wall, a support section extending from said holder body section and supporting said flashlight body, a protecting section horizontally extending from said holder body section and covering said electric lighting section of said flashlight body, and a cap pivotally supported by opposite ends of said support section through a hinge shaft;

on said receiving section included in said flashlight body, a transversely lengthy through slot is formed, and on said support section of said holder, a partition plate is placed and extended in a location corresponding to said through slot, so that said partition plate is inserted into said receiving section via said through slot of said receiving section and interposed between said batteries, interrupting electrical contact between said batteries when said flashlight body is fitted in said holder; and wherein said lower end of said cap and said lower end of said support section to be abutted and locked to each other are made of a conductive material and a circuit is formed on their surface, in order to sound an alarm when they are separated from each other.

8. The emergency flashlight as claimed in claim 7, wherein said flashlight body includes a speaker for sounding an alarm when said flashlight is separated from said holder.

9. The emergency flashlight as claimed in claim 7, wherein a glass cutting edge is attached to one side of said flashlight body, and a hammer piece is attached to another side of said flashlight body.

* * * * *